United States Patent [19]

Pullman

[11] 4,451,985

[45] Jun. 5, 1984

[54] DRAWING APPARATUS

[76] Inventor: Burke C. Pullman, 31, Gledhow Gardens, London, SW. 5, England

[21] Appl. No.: 325,439

[22] PCT Filed: Apr. 8, 1981

[86] PCT No.: PCT/GB81/00063

§ 371 Date: Nov. 20, 1981

§ 102(e) Date: Nov. 20, 1981

[87] PCT Pub. No.: WO81/02842

PCT Pub. Date: Oct. 15, 1981

[30] Foreign Application Priority Data

Apr. 9, 1980 [GB] United Kingdom ..... 8011728

[51] Int. Cl.[3] ..... B43L 13/00

[52] U.S. Cl. ..... 33/18 R; 33/DIG. 1; 434/85; 434/409

[58] Field of Search ..... 33/18 R, 26, DIG. 1; 434/85, 90, 409

[56] References Cited

U.S. PATENT DOCUMENTS

| | | | |
|---|---|---|---|
| 3,055,113 | 9/1962 | Grandjean | 33/18 R |
| 3,103,751 | 9/1963 | McDonald | 434/409 |
| 3,416,231 | 12/1968 | Mercorelli | 33/18 R |
| 3,585,735 | 6/1971 | Miller | 434/409 |
| 3,760,505 | 9/1973 | Clark | 33/18 R |

FOREIGN PATENT DOCUMENTS

| | | | |
|---|---|---|---|
| 1761442 | 8/1973 | Fed. Rep. of Germany | 434/409 |
| 1945784 | 2/1978 | Fed. Rep. of Germany | 434/85 |
| 2758642 | 5/1979 | Fed. Rep. of Germany | 434/85 |
| 2901601 | 7/1980 | Fed. Rep. of Germany | 33/18 R |
| 2901651 | 7/1980 | Fed. Rep. of Germany | 33/18 R |

*Primary Examiner*—Richard R. Stearns

[57] ABSTRACT

Drawing apparatus has a screen (4, 24) forming one wall of a chamber containing liquid or powder material and a scriber (2, 11, 26). A guide "pen" (3, 13) magnetically attracts the scriber into contact with the screen and as it is moved over the surface the scriber tracks it, making a visible line in the material adhering to the underside of the screen. The surface may have means for producing signals as the pen and scriber traverse, each signal being identifiable with a particular point. If the succession of signals match a stored program, a sound associated with the figure drawn is generated.

7 Claims, 8 Drawing Figures

DRAWING APPARATUS

Figure 1:
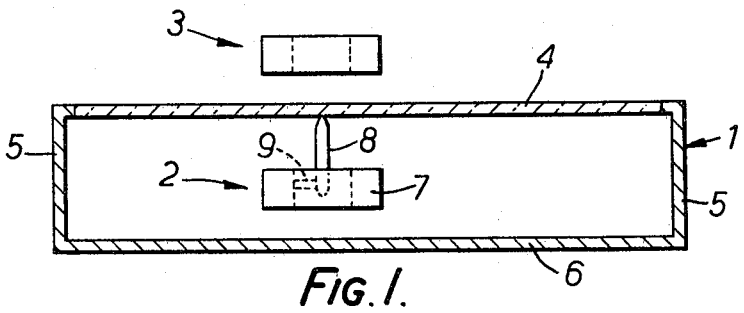

This invention relates to drawing apparatus. It concerns the type of apparatus in which a line is drawn on the coated, inaccessible side of a screen by a remote controlled stylus which etches away part of the coating. The figure shows through the screen as it is created, and the coating can subsequently be restored to entirety, ready for a fresh drawing. Such a coating is generally a powder of such fineness that it will adhere to a glass or plastics screen by surface tension. The screen forms the top of a closed box containing the powder, and by inverting the box the screen is completely covered. On re-inversion, sufficient powder particles remain adhering to form a completely opaque screen. Such apparatus is primarily a toy or for playing graphic games, although it could have more serious uses, for example in teaching.

In one known form the stylus is controlled by two independently operable knobs which move the stylus in mutually perpendicular directions. Straight lines in those directions are then simple, but curves, circles and straight lines in other directions extremely difficult. There also tend to be problems with the complex mechanics of the two traverse mechanisms. It is the aim of this invention to make such apparatus simpler and yet more versatile.

According to the present invention there is provided drawing apparatus comprising a closed chamber one wall of which is a translucent screen and which contains liquid or powder of non-magnetic material that will adhere as a coating to said screen even when the interior surface thereof is downwardly facing, a scriber within the chamber for co-operating with said screen, and a movable guide member external to the chamber, the scriber and guide member having a mutual magnetic attraction so that movement of the guide member adjacent the chamber causes the scriber to trace a corresponding line in said coating, visible externally.

The screen does not have to be flat and rectangular, and generally there are few restrictions on its shape.

The re-coating will be achieved by temporarily inverting the chamber, as described previously. Powder will be preferred, but some viscous liquids may be suitable.

It is highly desirable that only the stylus should touch the interior surface of the screen. Therefore, arrangements will be made to ensure that the scriber will not impinge at any other point. Also, it is very important that the scriber should not build up a lump of powder or blob of liquid that would smear or produce an ill-defined line. Therefore arrangments will also be made to ensure that there is immediate clearance for the material etched away by the stylus.

The magnetic attraction may be generated in several ways, preferably by means of a rare earth magnet. There may be two permanent magnets, one in the scriber, the other in the guide member, or one could include material of high magnetic permeability, and the other a permanent magnet, or (if on the guide member) an electromagnet.

In one preferred form, means may be provided for generating electrical signals in response to the drawing of a picture, and for generating a sound related to the picture if it is drawn in a predetermined manner.

Figure 2:
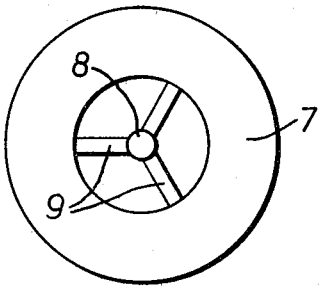
Figure 3:
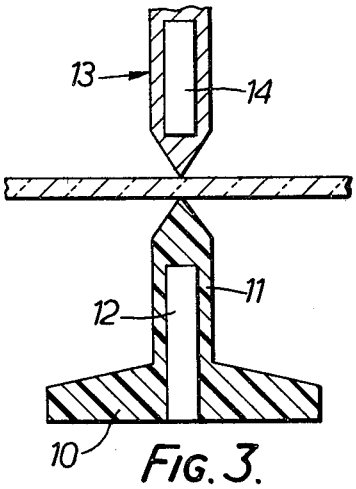
Figure 4:
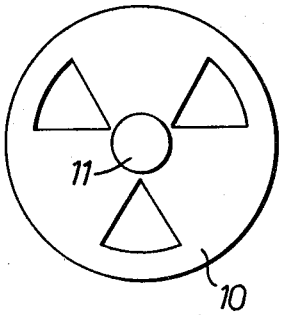
Figure 5:
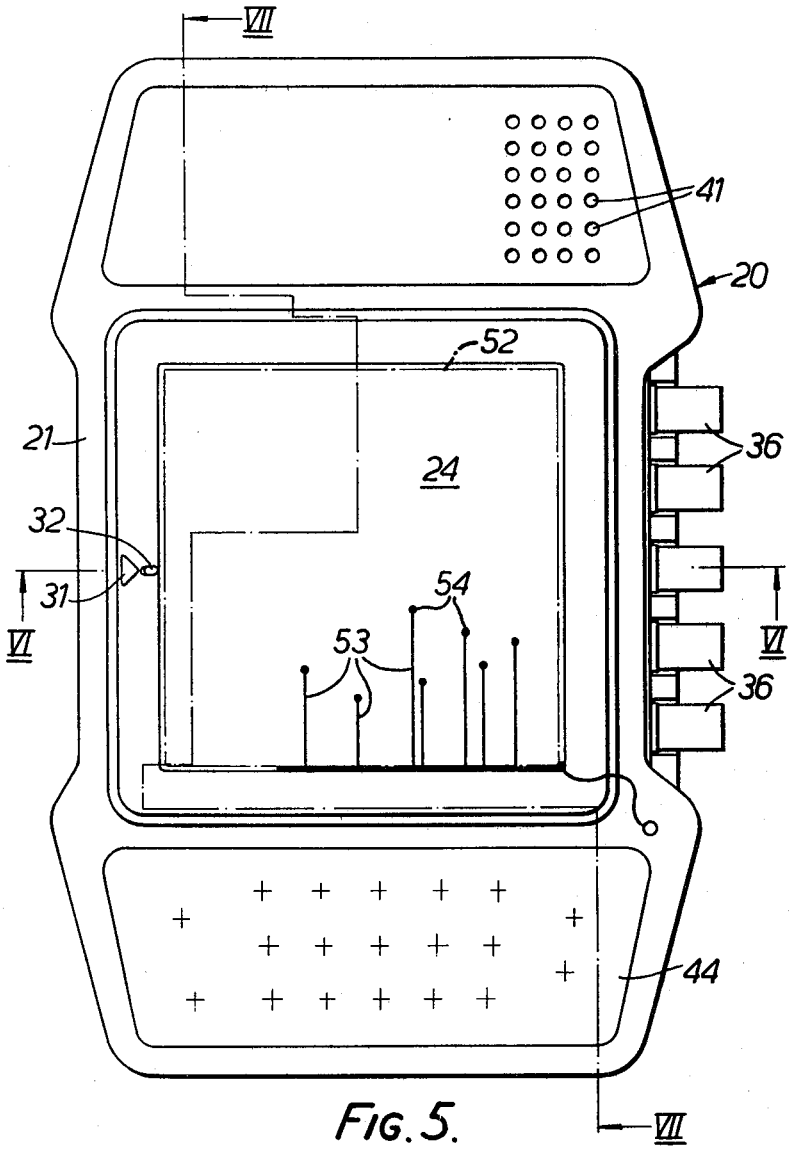
Figure 6:
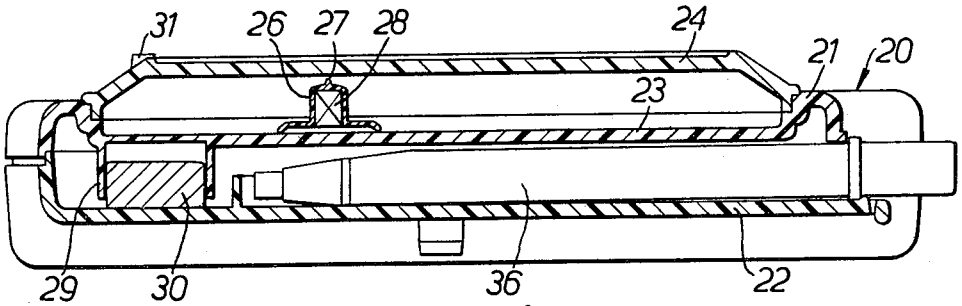
Figure 7:
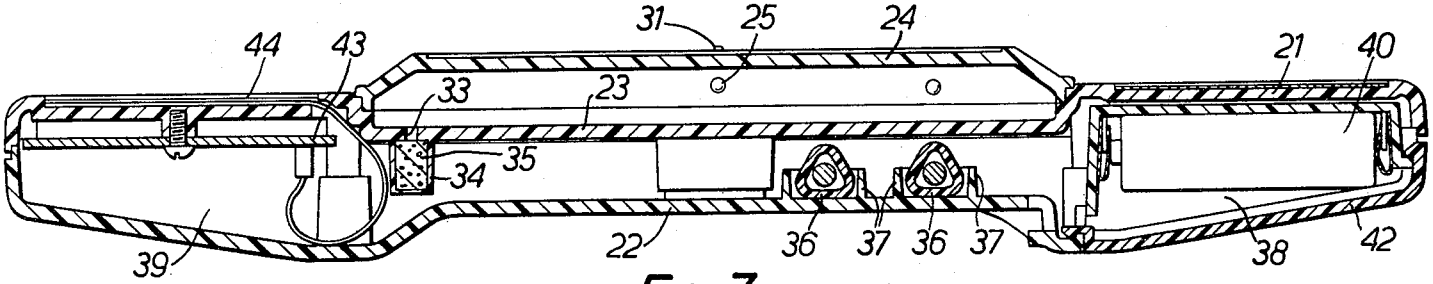
Figure 8:
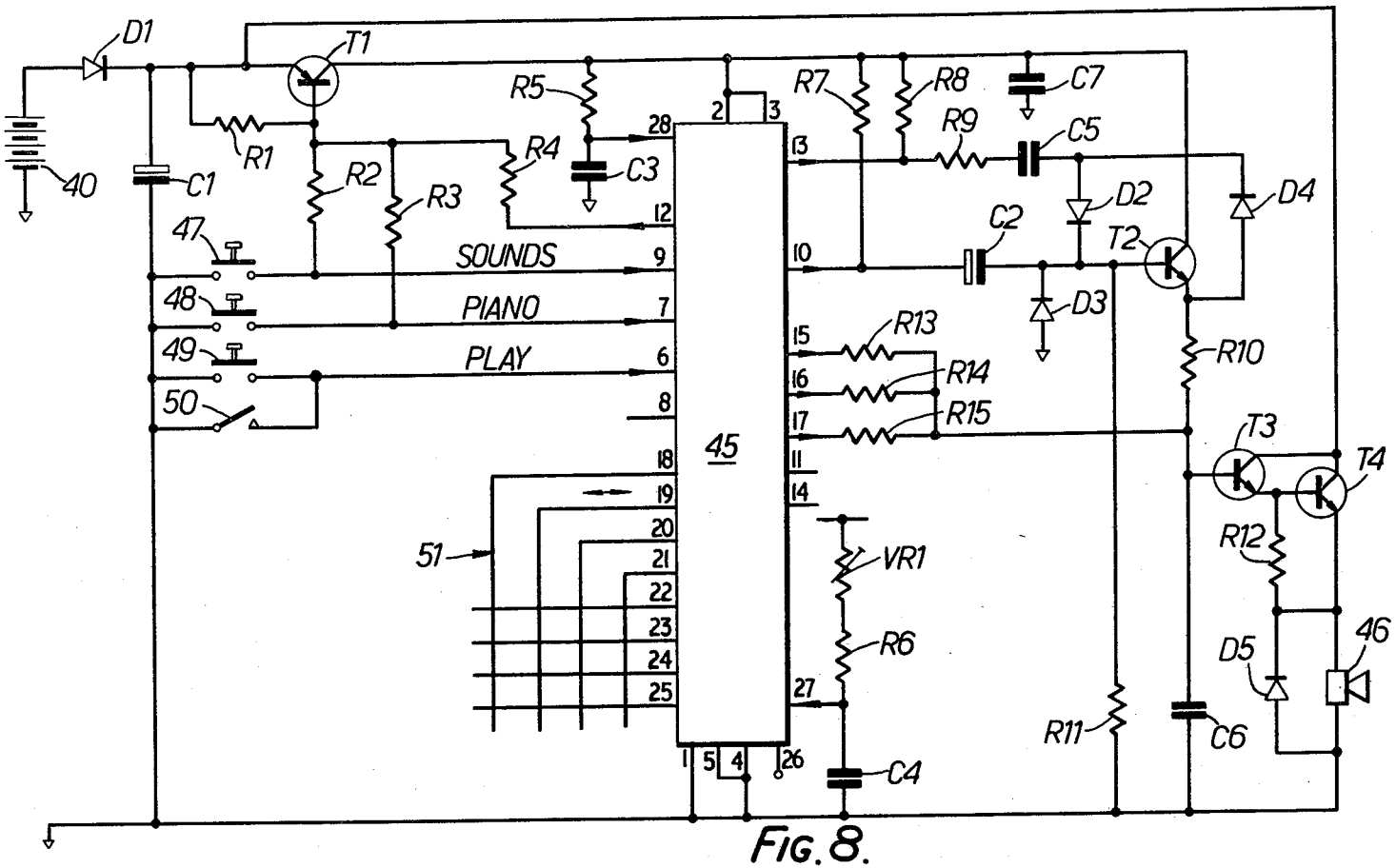

For a better understanding of the invention some embodiments will now be described, by way of example, with reference to the accompanying drawings in which:

FIG. 1 is a diagrammatic cross-section of a drawing apparatus, showing a scriber and a guide member, FIG. 2 is a plan view to a larger scale of the scriber of FIG. 1, FIG. 3 is a vertical section through another scriber and associated guide member, FIG. 4 is a plan view of the scriber of FIG. 3, FIG. 5 is a plan view of a practical embodiment of drawing apparatus, also incorporating a sound system, FIG. 6 is a section on the line VI—VI of FIG. 5, FIG. 7 is a section on the line VII—VII of FIG. 5, and FIG. 8 is a circuit diagram of a sound producing system.

The drawing apparatus of FIG. 1 comprises a shallow box 1 inside which is a scriber 2 and outside which is a guide member 3, henceforth simply referred to as a pen as it is manipulated in the same way. The box is completely closed and its top is provided by a translucent, and possibly transparent, screen 4 of glass or plastics. A quantity of powder (not shown) of extreme fineness (about 5 micron) and of non-magnetic material such as copper or zinc is sealed within the box chamber and adheres as described above to the underside of the screen 4. The sides 5 and bottom 6 of the box are also of non-magnetic material.

The scriber 2 consists of a permanent ring magnet 7 in the centre of which is mounted a stylus or scribe 8 by means of radial spokes 9. The stylus projects upwardly beyond the ring 7 whose thickness and radius are such that, when the tip of the stylus is against the underside of the screen 4, the scriber 2 cannot capsize (because the ring 7 meets the bottom 6 before that can happen) and when the scriber 2 is in this extreme tilted position, the upper outer edge of the ring is still clear of the underside of the screen, thus ensuring that no extraneous marks are made.

The pen 3 has another ring magnet of similar size, which will attract the member 2 upwardly so that the stylus 8 is urged against the underside of the screen. As the pen 3 is pushed around over the screen, so the scriber 2 will follow and the stylus will etch a line in the powder which will be visible from above the screen. It will be appreciated that the pen 3 can be guided along straight edges or around templates to trace out any desired figure. The actual point of scribing will be visible through the ring, and inside the box the powder removed by the stylus is free to fall through the ring and will not build up into a lump.

The alternative scriber of FIGS. 3 and 4 has a perforated disc base 10 with a central, upstanding hollow stem 11, pointed at its upper end (or possibly with a small round or flat) to form the stylus. This may be integrally formed in plastics material. A permanent cylinder magnet 12 is housed within the stem 11. A pen 13 for this scriber has another cylinder magnet 14 near its tip, which is pointed to allow the line being drawn to be seen fully and to make tracing of a template accurate. The perforations in the disc base 10, each in the form of a sector, allow the powder to fall through with reasonable freedom, while the base itself forms an anti-capsize collar which will not impinge on the screen, in the manner of the ring magnet 7.

The pen in either version may not be simply hand-held; it could be mounted on a linkage, as with draughtsman's boards, or form part of a pantograph, for example.

In all versions, each magnet is of the rare earth type, which makes for compactness, strength and durability. An iron magnet would generally be too bulky, and too liable to lose strength.

A practical embodiment is shown in FIGS. 5, 6 and 7. It also incorporates a sound producing system which will be described in more detail later.

A generally rectangular casing 20 is formed by upper and lower mouldings 21, 22 in plastics material. The upper moulding 21 has a central shallow square well 23 which is closed by a slightly raised transparent screen 24, over the outside of which a "pen" can be traversed. The closed chamber formed by the moulding 21 and the screen 24 contains the powder, which can be distributed by spreaders 25, and a scriber 26. The spreaders 25 are simply glass or other non-magnetic balls which can be rolled over the underside of the screen when the device is inverted and tilted back and forth. They will not interfere with the scriber when it is drawing. The scriber 26 is a plastics moulding in the shape of a hat with a down-turned brim and a point 27 at the crown which will trace a line in the powder adhering to the inside of the screen. This shape readily sheds any powder falling from the screen. The inside of the "hat" contains a cylindrical magnet 28. The clearance between the point 27 and the underside of the screen is small when the scriber is resting in the well, and within the pen a corresponding magnet, oriented to attract, will easily lift the scriber up against the screen. The "hat brim" will prevent capsize, and limit tilting to a small angle.

The scriber is hidden from view when the device is primed ready for drawing, since the entire screen will be made opaque by the powder. It therefore has to be found. To enable this to be done, there is provided within the casing below one edge of the well, a compartment 29 which loosely houses a scriber lock 30. This is simply a block of magnetically permeable material such as mild steel. Directly above it, moulded into the screen 24, there is a pointer 31 opposite whose apex there is a zone 32. When the device is to be used, it is inverted so that the powder makes the screen opaque, and the side of the screen with the pointer is held lowermost. The scriber therefore slides down to that side. The block 30 will be resting on what is normally the roof of the compartment 29. By manipulating the device, the scriber can be worked unseen along to the centre until the point 27 registers with the zone 32. The magnet 28 interacts with the block 30, and the scriber is firmly located. This can be tested by tilting the device and listening for any scriber movement. When the device is re-inverted its position will be known. The block 30 is sufficiently heavy to fall back onto the base moulding 22 against any magnetic influence, but if the device is held reasonably level the scriber will not move. The pen can then be put on the zone 32 and when moved over the screen the scriber will follow.

Although the powder chamber is closed, provision is made for it to "breathe", for example to cope with changes of pressure due to temperature. As shown in FIG. 7, there is an aperture 33 in the well which leads into a compartment 34 which houses a filter 35. This enables the pressure in the powder chamber to equalise with that outside, but prevents escape of the powder.

The space below the well 23 is used to house crayons 36, each having location ribs 37 integrally formed with the base moulding 22. These are entered from one side, and when fully housed their ends just project as shown in FIG. 5. Usually, they will be of different colours, to use on the screen when the initial figure has been drawn.

At the ends of the casing there are compartments 38 and 39. The compartment 38 houses batteries 40 and a speaker whose presence is indicated by perforations 41 in the upper moulding 21. The lower moulding 22 has a door 42 for access to the batteries. At the other end, compartment 39 has a printed circuit board 43 and a panel on the upper moulding 21 provides a keyboard 44.

A possible sound system is illustrated in FIG. 8, where the various electronic components and their connections are shown and referenced in conventional form and will not be described in detail. The central block 45 represents a microcomputer, for example General Instruments 1655, henceforth referred to as chip 45. Its normal pin references 1 to 28 are retained and should not be confused with similar references above. The batteries 40 are indicated symbolically, and the loudspeaker beneath the perforations 41 by the reference 46. Switches 47 to 50 are part of the keyboard 44, and further switches (not shown) on that keyboard lead to eight lines 51 connected to pins 18 to 25.

The chip 45 is pre-programmed with a number of sounds, for example of various animals, birds or insects, or of human artefacts such as trains, aeroplanes or cars. It is also programmed with fifteen different notes from the piano keyboard. When the button switch 47 is pressed a circuit is closed through resistor R2 and power is applied to the "sounds" input 9. Although the switch 47 may then be released the power remains on by a self-latching action via terminal 12 and resistor R4. It is arranged that this power remains on for about 45 seconds and then cuts off. A similar arrangement holds for the piano button switch 48. This simply enables the chip 45; the actual sound produced is determined by inputs on lines 51.

The play input 6 can be activated either by a press button switch 49 or a more permanent switch 50. When either of these are closed, the lines 51 can be used for entering a program.

The properties and functions of other components are as follows. On the input side, the diode D1 guards against reverse battery connection and keeps the chip 45 to an appropriate working voltage, while capacitor C1 is an optional supply reservoir. T1 is an auto-power-down transistor with resistor R1 ensuring minimal leakage through it when the circuit is not powered up, and providing a clean cut off when the chip relinquishes its hold on R4. R5/C3 have a time constant greater than 1 mS and feed to the master clear pin 28 of the chip 45 to allow safe period for initialisation. An oscillator frequency is set by VR1/R6/C4 and applied to pin 27. This can be checked from pin 26, and VR1 may be sealed in its set position to prevent movement by vibration.

On the output side, C5 couples the envelope pump signal to the diode pump, C7 is an optional filter for the chip supply, and R12 is a loudspeaker cut-off resistor which ensures minimum leakage through the speaker when the device is not in use. Envelope capacitor C2, in conjunction with R11, determines the amplitude variability of sounds, especially that of a bee, and the decay time of the piano. The other resistors and capacitors are primarily selected for sound quality, envelope pull-up resistor R7 giving the initial "attack" of all sounds. Envelope pump pull-up resistor R8 and current limiter R9 are not concerned with the "piano", and the value of R9 is particularly important for the bee sound. Envelope pump system diodes D2, D3 and D4 do not have to be high speed signal diodes, while loudspeaker bypass diode D5 is optional, but advisable to by-pass reverse transients from the speaker which might damage the base emitter junction of T4.

The production of sound from this circuit may be initiated in several ways. A keyboard switch may be operated to energise one of the lines 51, and depending on whether "sounds" or "piano" have been previously enabled, an associated noise or tune is played. More intimately connected with the drawing aspect, however, is an arrangement whereby drawing a certain figure can produce a related sound. This can be achieved by a thin transparent matrix overlay 52 for the screen, containing fine electrical conductors 53 leading to various marked points 54. The conductors 53 can be coupled to lines 51. When the pen and scriber register with any of these points an electrical signal is generated, either by physical pressure of the pen making a contact or altering a capacitance within the matrix, or by using the local magnetic field. A sequence of these signals at pins 18 to 25 can be compared with a memorised program and if a match is obtained a sound or tune will be generated. For example if the points followed result in a picture of a lion, the loudspeaker will issue a roar. Thus the well-known children's game of 'joining the numbered dots' is augmented by appropriate sounds. Furthermore, no visible trace is left on the matrix, which can be used repeatedly.

Instead of replaceable matrices, the screen could be permanently sensitised or made responsive at a multitude of points, and these could be on the side facing into the chamber so that the stylus itself would activate each point. Their positions would be identifiable, and according to the order in which they were pressed a different sound would be generated.

I claim:

1. Drawing apparatus comprising a closed chamber one wall of which is a translucent screen and which contains liquid or powder of non-magnetic material that will adhere as a coating to the screen even when the interior surface thereof is downwardly facing, a scriber within the chamber having a base for cooperating with the chamber wall opposite said screen and a stylus upstanding therefrom for cooperating with the screen, the base having a span which prevents significant tilting of the scriber and the height of the scriber being such that, with the base resting on said opposite wall, the tip of the stylus is marginally clear of the screen, and a pen-like movable guide member external to the chamber, the scriber and guide member having a mutual magnetic attraction, whereby movement of the guide member over the screen raises the stylus into contact with the underside thereof and causes the stylus to scribe an externally visible line corresponding to said movement.

2. Apparatus as claimed in claim 1, wherein there are mean for locating the scriber in a set position when the apparatus is out of use, the locating means comprising an element external to the chamber, loosely captive, and movable between close and remote positions in relation to the chamber in response to the orientation of the chamber, the scriber and said element having a mutual magnetic attraction, when the latter is in said close position, thereby to locate the scriber, which attraction is surpassable by that of the guide member when said element is in the remote position.

3. Apparatus as claimed in claim 2 wherein means are provided for generating electrical signals in response to the drawing of a picture and for generating a sound related to the picture if it is drawn in a predetermined manner.

4. Apparatus as claimed in claim 3, wherein the generating means includes a matrix overlay for the screen with points responsive to the proximity of the guide member and/or scriber to produce said signals, and means for correlating the sequence of said signals with a memorised sequence.

5. Apparatus as claimed in claim 1, wherein the magnetic attraction is provided by a rare earth magnet.

6. Apparatus as claimed in claim 1, wherein the chamber has venting, with means in the venting to prevent escape of the liquid or powder material within the chamber.

7. Apparatus as claimed in claim 1, wherein the scriber stylus has a pointed tip and its base is inclined and apertured to shed material removed from the screen by the tracing.

* * * * *